United States Patent [19]

Deeg et al.

[11] 4,363,942

[45] Dec. 14, 1982

[54] ASSEMBLY FOR THE KEYBOARDS OF ELECTRIC TYPEWRITERS OR SIMILAR MACHINES

[75] Inventors: Reinhard Deeg, Keltern; Oswald Hack, Pforzheim, both of Fed. Rep. of Germany

[73] Assignee: International Standard Electric Corporation, New York, N.Y.

[21] Appl. No.: 232,315

[22] Filed: Feb. 9, 1981

[30] Foreign Application Priority Data

Feb. 27, 1980 [DE] Fed. Rep. of Germany ..... 3007239

[51] Int. Cl.[3] ..... H01H 3/12

[52] U.S. Cl. ..... 200/5 A; 200/159 R; 400/479;495

[58] Field of Search ..... 200/5 R, 5 A, 5 B, 5 C, 200/5 D, 5 E, 5 EA, 5 EB, 5 F, 340, 159 R, 159 A, 159 B, 292; 235/145 R; 400/479, 479.2, 495, 495.1; 340/365 R, 365 A, 365 C, 365 L, 365 P, 365 S, 365 VL

[56] References Cited

U.S. PATENT DOCUMENTS

| | | | |
|---|---|---|---|
| 3,141,945 | 7/1964 | Juggins | 200/159 R |
| 4,056,700 | 11/1977 | Stannek | 200/340 |
| 4,066,860 | 1/1978 | Kawasaki | 200/5 A |
| 4,127,752 | 11/1978 | Lowthorp | 200/5 A |
| 4,262,182 | 4/1981 | Basler et al. | 200/314 |
| 4,286,131 | 8/1981 | Kopish et al. | 200/340 |

*Primary Examiner*—A. T. Grimley
*Assistant Examiner*—Morris Ginsburg
*Attorney, Agent, or Firm*—James B. Raden; William J. Michals

[57] ABSTRACT

A key assembly for the keyboards of electric typewriters or similar machines in which a one-piece baseplate forms the cover for the assembly. Crossing webs on the bottom side of the baseplate serve as spacers for the keyboard elements and also as the basis for mounting a contact mat provided with contact beads as well as the associated printed circuit board. The keyboard elements are mounted in the baseplate from above.

8 Claims, 7 Drawing Figures

ASSEMBLY FOR THE KEYBOARDS OF ELECTRIC TYPEWRITERS OR SIMILAR MACHINES

CROSS-REFERENCE TO RELATED APPLICATION

Reference is made to the disclosure in copending applications of M. Muller et al., Ser. No. 073,994, filed Sept. 10, 1979, now abandoned, and Ser. No. 211,428 filed Nov. 28, 1980, now U.S. Pat. No. 4,316,066.

BACKGROUND OF THE INVENTION

The present invention relates to a key assembly for the keyboards of electric typewriters and similar machines and, more particularly, to a key assembly containing a plurality of vertically guided keyboard elements which, upon actuation, act upon domed contact beads of a contact mat arranged below the keyboard elements, with the contact mat, in turn, resting on a printed circuit board.

A keyboard utilizing a key assembly of the kind referred to above is disclosed in German patent application (DE-AS) 23 50 176. When used with an electronic pocket calculator, the keyboard elements are inserted into the upper part of the housing while the contact mat and the printed circuit board are arranged in the lower part of the housing. By a spring plate, the keyboard elements are pushed into their normal positions into which they are lifted by the beads of the contact mat.

This arrangement requires high dimensional accuracy in assigning the reference surfaces between the keyboard elements and the contact mat. Under certain circumstances, greater tolerances are responsible already within the relatively small key pad of an electronic pocket calculator, for noticeable differences in the key travel.

With regard to keyboards of electric typewriters and similar machines which, not only from the surface, but also from the number of keys are considerably more voluminous, it appears that the principle of the known type of construction cannot be applied thereto. Owing to the guide lines on the ergonomic design of keyboards, certain requirements are placed with a view to the key travel and the operating force, demanding an exact, narrow-tolerated assignment of the keyboard element to the respective contact bead.

It is, therefore, the object of the invention to provide a key assembly for electric typewriters and similar machines which may use a contact mat and meets the above requirements.

SUMMARY OF THE INVENTION

According to a principal aspect of the present invention, there is provided an assembly for keyboards of electric typewriters or similar machines comprising a plurality of vertically guided keyboard elements each consisting of a key head and a key plunger. When actuated, each keyboard element acts via its plunger upon a domed or other type of contact arranged between the plunger and a printed circuit board. The key assembly comprises a baseplate in which the keyboard elements are mounted from above. Detent means releasably retains the keyboard elements in the baseplate. The baseplate is formed on its bottom side with a plurality of elongated supports. The printed circuit board is firmly connected to the bottoms of the supports.

The advantages achievable by the invention reside primarily in that no high demands have to be placed on the evenness of the baseplate, because both the contact mat and the printed circuit board, owing to the positive connection between them, resiliently adapt each other to any possible warpings of the baseplate. In this way it is possible to manufacture the baseplate as a one piece injection molded part from a thermoplastic material. Because of the reduced requirements placed on the evenness of the baseplate, the baseplate may be formed as an integral part of the keyboard cover. This results in a very economical manufacture of the keyboard. In addition, direct accessibility to the keyboard is provided upon lifting the cover of the keyboard, thus making service of the keyboard very easy. A further advantage results from the fact that the keyboard elements can be inserted from above into the baseplate. Owing to customer requirements deviations in the order of ten percent result in the equipping of the keyboard. Owing to the possibility of being able to insert the keyboard elements from above, it is possible to prefabricate basic keyboard versions which, later on, only need to be completed in accordance with the respective customer requirements.

DESCRIPTION OF THE PREFERRED EMBODIMENTS

Figure 1:
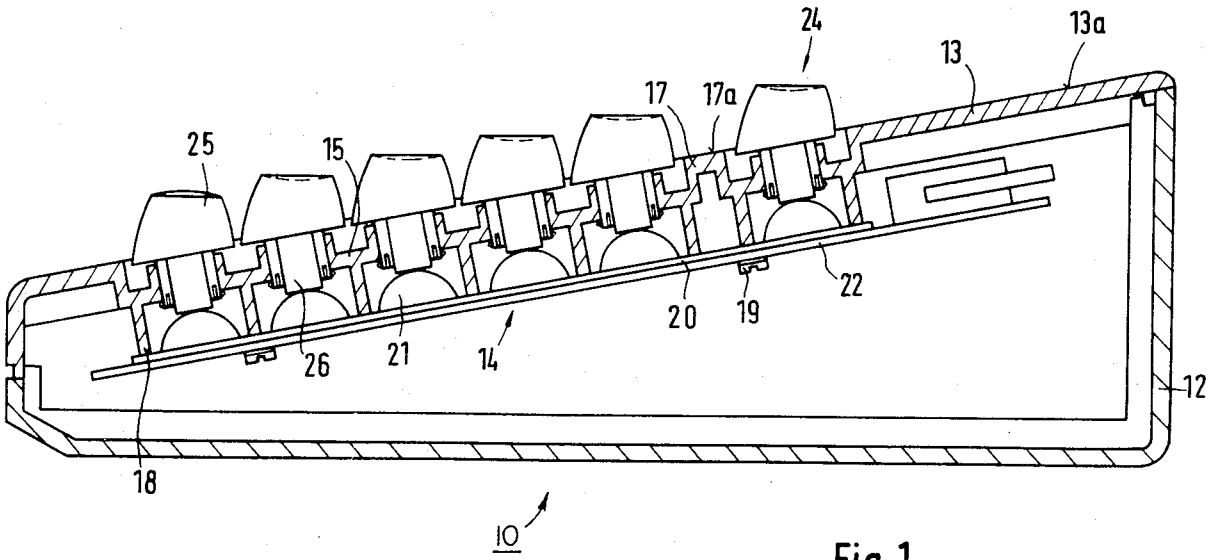
FIG. 1 is a sectional view taken along line 1—1 of FIG. 2 schematically showing a keyboard utilizing a key assembly integrated into the keyboard cover, according to the invention.
Figure 2:
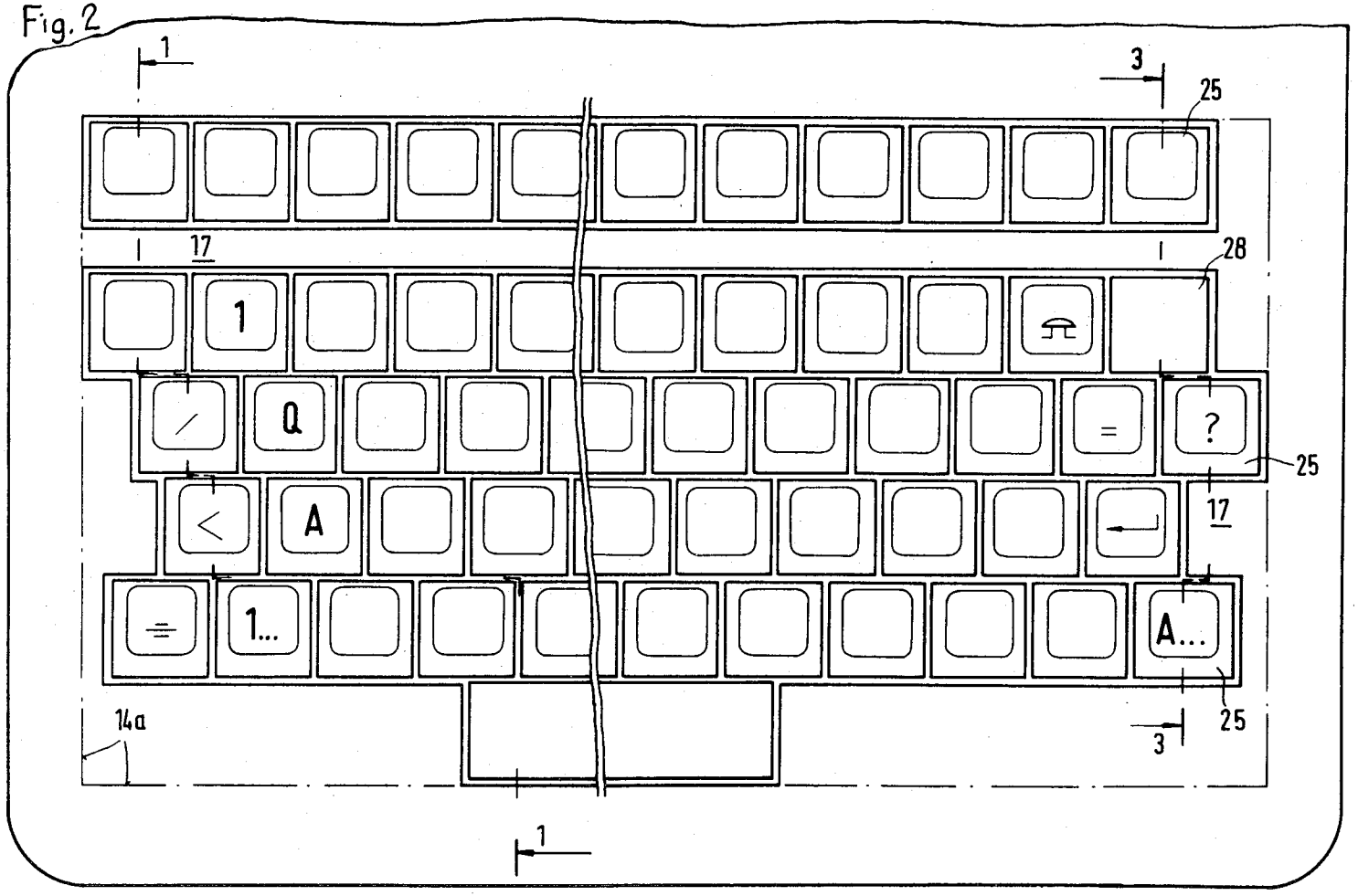
FIG. 2 is a top plan view of the keyboard shown in FIG. 1.

Referring now to the drawings in detail, the keyboard 10 of the invention consists of a bottom part 12 and of a cover 13. Into this keyboard cover the key assembly 14 is integrated so that a baseplate 15, forming the basis of the key assembly 14, forms one common part with the cover 13. It is, therefore possible and preferred to manufacture this part by an injection molding process in one step of operation. In FIG. 2, the dot-and-dash line 14*a* represents an imaginative parting line between the keyboard cover 13 and the key assembly 14.

Figure 3B:
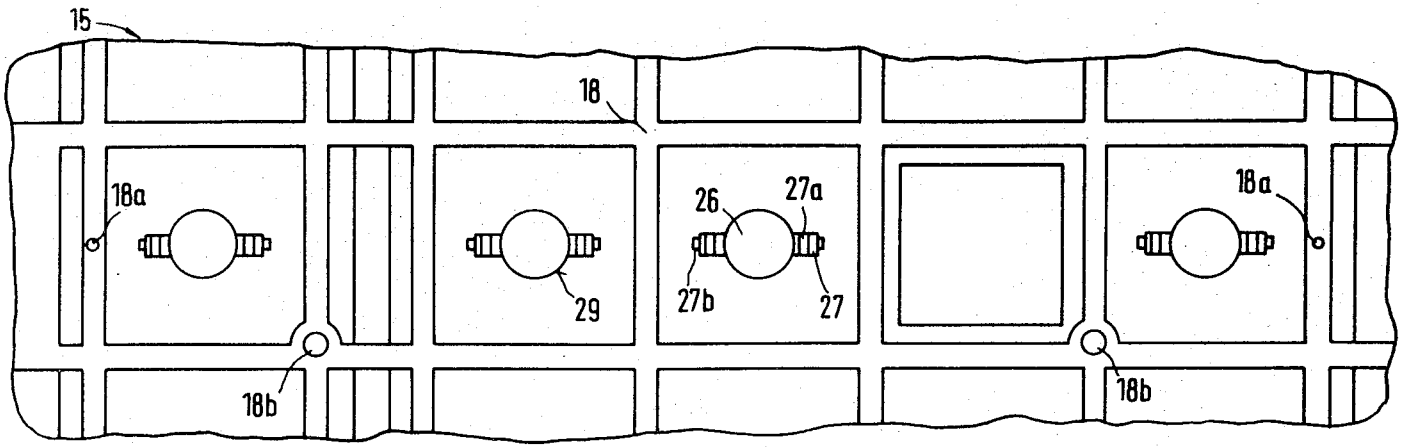
FIG. 3*b* shows the arrangement of FIG. 3*a* in a view from the bottom side of the baseplate with both the printed circuit board and the contact mat removed.

To reinforce the baseplate 15, the latter is provided on its bottom side with equally spaced elongated webs 18 which, as seen in FIG. 3*b*, are disposed in a crosswire arrangement. In the center between the webs 18, key guides 16 (FIG. 5) are formed on the baseplate 15 for the keyboard elements 24 forming the key set. The baseplate 15 is lowered in accordance with the actuating travel of the keyboard element 24, with respect to the surface 13*a* of the keyboard cover 13. Web-shaped portions 17 between rows of keys within the dot-and-dashed line box 14*a* lie with their upper surfaces 17*a* in a common plane with the upper surface 13*a* of the keyboard cover 13. The height of the webs 18 is directly related to the actuating travel of the keyboard elements 24. The webs have equal heights among each other within narrow tolerances. Lying against the bottoms of the webs 18 is a printed circuit board 22 with a contact mat 20 clamped therebetween. The printed circuit board is connected firmly to the baseplate 15 by means of screws 19. The contact mat 20 is provided in the conventional manner with a plurality of contact beads 21 which are arranged in accordance with the divisional spacing of the keyboard elements 24 and project into the spaces between the webs 18.

The keyboard elements 24 each substantially consists of a key head 25 and a key plunger 26. The elements 24 are inserted from above into the aforementioned guides 16 on the baseplate 15. The keyboard elements engage behind the baseplate 15. This engaged position is determinative of the normal position in which the key plungers 26 are in slight contact with the respective contact bead 21. In this way, the keyboard elements 24, without being provided with an additional spring force, are provided with a slight bias in accordance with the guide lines for ergonomically designed keyboards. By the defined, narrow-tolerated spacing between the contact mat 20 and the baseplate 15 it is assured that the bias of the keyboard elements 24 is essentially constant, and that the difference in the actuating force between neighbouring keyboard elements does not exceed a value of 0.05 N (5p). Apart from corresponding guide lines, these values are decisively determinative of the quality of operability of a keyboard.

Figure 3A:
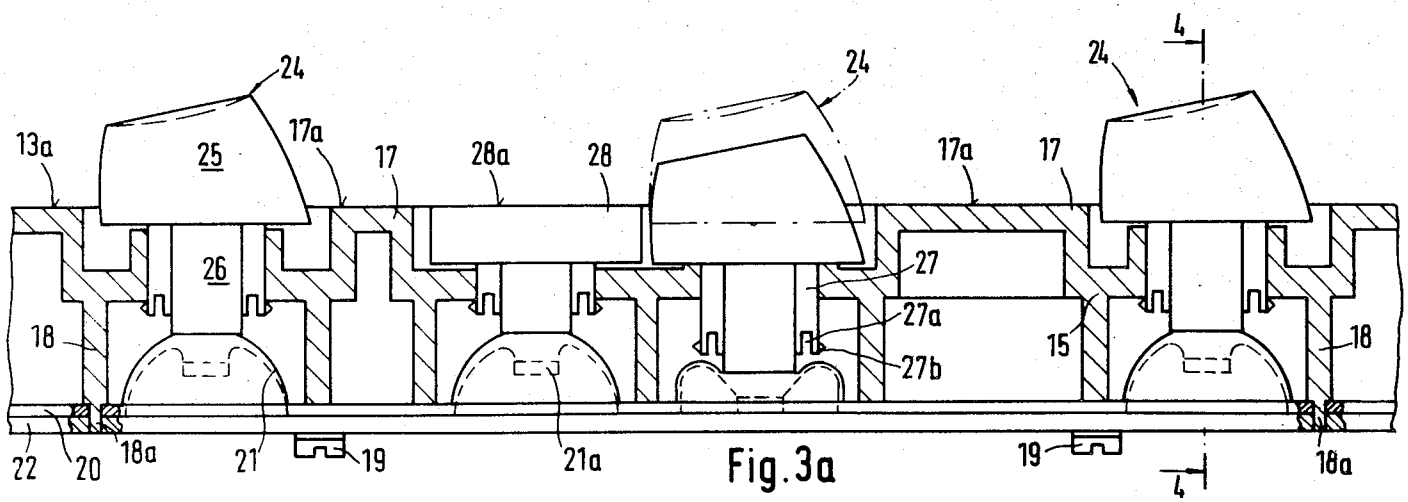
FIG. 3*a* shows, on an enlarged scale, the key assembly of FIG. 1 in a section taken along line 3—3 of FIG. 2.
Figure 4:
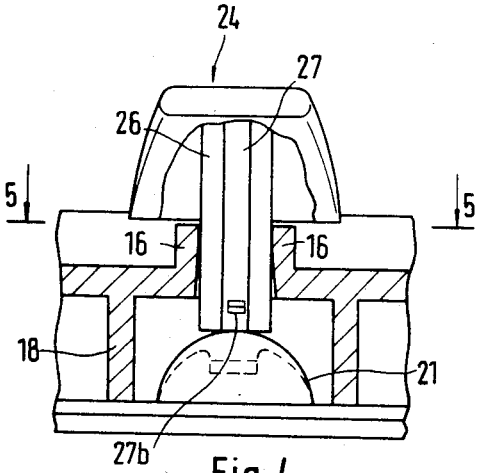
FIG. 4 is a sectional view taken along line 4—4 of FIG. 3*a;*
Figure 5:
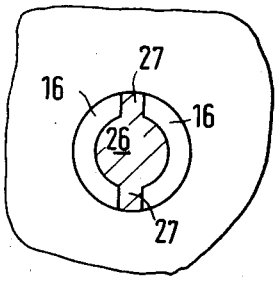
FIG. 5 is a sectional view taken along 5—5 of FIG. 4.

The keyboard elements 24 are snapped into the baseplate 15. As seen in FIGS. 4 and 5, the round key plunger 26 is provided with diametrically arranged guide webs 27 to prevent rotation of the keyboard element. The baseplate 15 is provided with a guide hole 29 corresponding to the aforementioned cross section of the plunger 26. As is evident from FIGS. 4 and 5, the guides 16 are shell-shaped and fit around the cylindrical portions of the key plungers 26 so that vertical movability of the keyboard elements 24 is stabilized. As seen in FIG. 3*a*, the guide webs 27 are formed at their lower ends with slots 27*a*. The thus resulting resilient tongues are provided at their ends with outwardly directed detents 27*b*. These detents have a triangular cross section. Because of the corresponding inclined surfaces of the detents and the resiliency of the tongues, the individual keyboard element can be inserted from above into the baseplate 15. The detents 27*b*, in the inserted state engage below the baseplate 15 and retain the respective keyboard element 24 in the initial position into which it is urged by the slightly depressed contact bead 21. Owing to the double-sided inclination of the detents 27*b*, the keyboard elements 24, after overcoming the spring action of the engaging tongues, can be removed again from the key assembly. The force required to this end, however, is by a multiple greater than the pressure which the contact beads 21 exert upon the inserted keyboard elements 24 in their initial positions.

FIG. 3*a* shows the center one of the keyboard elements 24 in its actuated position. The domed portion of the contact bead 21 is shown to have been pushed inwardly by the key plunger 26. A contact pellet 21*a* inside the contact bead 21 comes to lie in the course of this movement on two neighbouring conductive leads (not shown) of the printed circuit board 22 thus completing a predetermined circuit. The guide webs 27 are somewhat shorter than the key plunger 26 for preventing them from coming into contact with the contact beads 21 in the depressed state.

As already mentioned hereinbefore, the way of arranging the elements of the keyboard may differ from user to user. Therefore, empty-panel tops 28 may be used for unused key positions. In their lower parts these tops 28 are designed in the same way as the keyboard elements 24, and snap correspondingly into the baseplate 15. The empty panel tops 28 are just high enough for their surface 28*a*, in the inserted state, to lie in the same plane as the keyboard cover 13.

For assuring proper functioning of the key assembly there is required an exact alignment of the contact mat 20 in relation to the key plungers 26 as well as a corresponding alignment of the printed circuit board 22 to the contact mat 20. For this reason, at least two set pins 18*a* are provided for in the grid arrangement of the webs 18, engaging into corresponding fitting holes (see FIG. 3*a*) in both the contact mat 20 and the p.c. board 22. For the purpose of fixing both the contact mat 20 and the p.c. board 22 in position, intersections of the webs 18 are reinforced at certain spaced locations, and are provided with fixing holes 18*b* (FIG. 3*b*). Both the contact mat 20 and the p.c. board 22 are provided with the holes through which screws 19 extend. The screws thread into the holes 18*b* to firmly connect the contact mat 20 and p.c. board 22 to the baseplate 15. In this way it is assured that, independently of the evenness of the baseplate 15, the spatial relationship between the keyboard element and the contact bead remains uniform throughout the entire extent of the key assembly.

Figure 6:
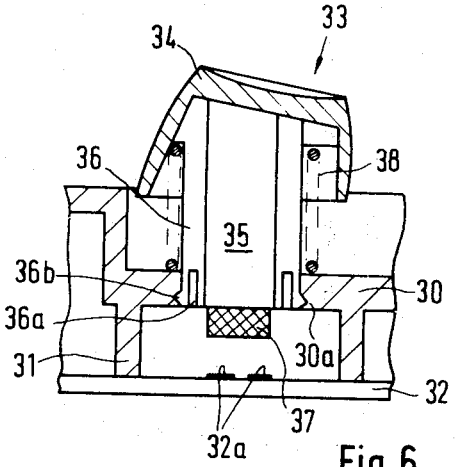
FIG. 6 shows an alternative key contact as applied to the key assembly of the invention.

FIG. 6 shows an alternative design of a key contact which is suitable for being used in connection with the key assembly described hereinbefore. In this version, the contact mat may be omitted. Instead, there is used a keyboard element 33 which, at the free end of the plunger 35, is provided with a rubber-elastic contact member 37. This contact member may consist of a conductive rubber or of a highly elastic material, such as expanded rubber, provided with a conductive top coating. The smaller space requirement in the vertical direction is compensated for by the use of shorter webs 31 by which the printed circuit board 32 is firmly connected to the baseplate 30. Two conductor leads 13*a* lie closely adjacent to one another directly below the contact member 37. The keyboard element 33 is substantially of the same design as the keyboard element 24 utilized in the design described hereinbefore. By having the same cross sectional shape, it merely differs therefrom by the guide webs 36 which have the same length as the key plunger 35. In the baseplate 30, the keyboard element 35 is guided in the same way as described hereinbefore. The guide webs 36 are likewise provided at their ends with longitudinal slots 36*a*, so that the outwardly protruding detents 36*b* are capable of giving way for enabling the insertion as well as the removal. Within the area of the detents 36*b*, the baseplate 30 is provided on its bottom side with inclined indentations 30*a*. These indentations are engaged by the detents 36*b* in the initial position into which the keyboard element 33 is yieldably biased outwardly by the action of a weak cylindrical spring 38. This spring has an internal diameter corresponding to the external diameter of the plunger guide (FIG. 5, item 16). It rests on one hand on the inside of the keyhead 34 and, on the other hand, on the baseplate 30. The cylindrical spring 38 is so dimensioned as to provide the prescribed actuating resistance. This force is substantially smaller than the force necessary for overcoming the spring action of the detents 36*b*.

What is claimed is:

1. A key assembly in a keyboard for electric typewriters or similar machines comprising a plurality of vertically guided keyboard elements each consisting of a key head and a key plunger, when actuated each keyboard element acting via its plunger upon a contact arranged between the plunger and a printed circuit board wherein the improvement comprises:

a baseplate;

said keyboard elements being inserted and removably mounted in said baseplate from above;

detent means releasably retaining said keyboard elements in said baseplate;

said baseplate having formed on its bottom side with a plurality of elongated supports;

said printed circuit board being firmly connected to the bottoms of said supports; and spring means arranged between said key head and said printed circuit board to bias said key head away from said baseplate and wherein the force of said spring means is less than the retaining force of said detent means.

2. A key assembly as set forth in claim 1 wherein:

said key assembly is an integral part of a keyboard cover.

3. A key assembly as set forth in claim 2 wherein:

said baseplate and said keyboard cover together form one part.

4. A key assembly as set forth in claim 2 wherein:

said baseplate having formed on its top side web-shaped portions located between the heads of said keyboard elements;

empty-panel tops are provided on said baseplate for empty positions on the keyboard; and the upper surfaces of said web-shaped portions and of said empty panel tops are in a plane common with the upper surface of said keyboard cover.

5. A key assembly as set forth in claim 1 wherein:

said supports are formed as crossed webs with some of the intersecting points thereof being partly reinforced; and said reinforced parts being provided with holes for receiving mounting means for holding said printed circuit board against said baseplate.

6. A key assembly as set forth in claim 1 including:

a contact mat clamped between said printed circuit board and said baseplate, said mat embodying a plurality of resilient contact beads extending upwardly into said baseplate between said supports.

7. A key assembly as set forth in claim 6 wherein:

said detent means normally positions said keyboard elements in said baseplate so that said plungers slightly depress said contact beads.

8. A key assembly as set forth in claim 1 wherein:

said plungers of said keyboard elements are provided at their lower ends with an elastomeric contact member; and said spring means is a compression spring is arranged between said key head and said baseplate.

* * * * *